United States Patent [19]

Koiwa

[11] Patent Number: 5,026,216

[45] Date of Patent: Jun. 25, 1991

[54] SHAFT CONSTRUCTION METHOD

[75] Inventor: Yoshinobu Koiwa, 172-14, Kotehashicho, Chiba-shi, Chiba-pref., Japan

[73] Assignee: Yoshinobu Koiwa, Chiba, Japan

[21] Appl. No.: 328,052

[22] Filed: Mar. 23, 1989

[30] Foreign Application Priority Data

Mar. 31, 1988 [JP] Japan ..... 63-79049
Apr. 11, 1988 [JP] Japan ..... 63-88622

[51] Int. Cl.[5] ..... E02D 3/12; E02D 5/46

[52] U.S. Cl. ..... 405/267; 405/233; 405/269

[58] Field of Search ..... 405/233, 236, 240, 266, 405/267, 269

[56] References Cited

U.S. PATENT DOCUMENTS 3,969,902 7/1976 Ichise et al. ..... 405/267
4,566,825 1/1986 Hirai et al. ..... 405/267
4,624,606 11/1986 Nakanishi et al. ..... 405/269

*Primary Examiner*—David H. Corbin

[57] ABSTRACT

A method of constructing shafts and continuous walls quickly and efficiently. The construction process consists of one step in which air and a ground hardener are injected through a jetting pipe element to form a column-shaped region of soil mixed with hardener; and another step in which a hardening inhibitor is injected into the soil-hardener mixture region by the jetting element, the shaft then being formed by excavating the portion of the ground that has not been hardened because of the presence of the inhibitor.

5 Claims, 8 Drawing Sheets

FIG. 3
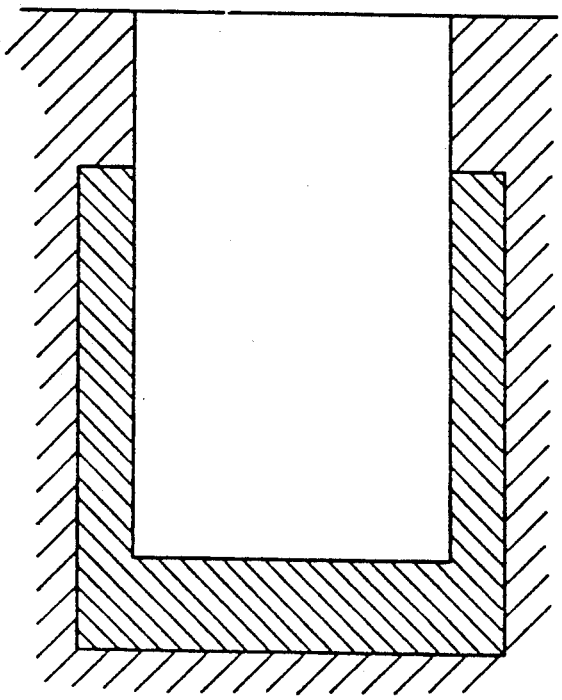
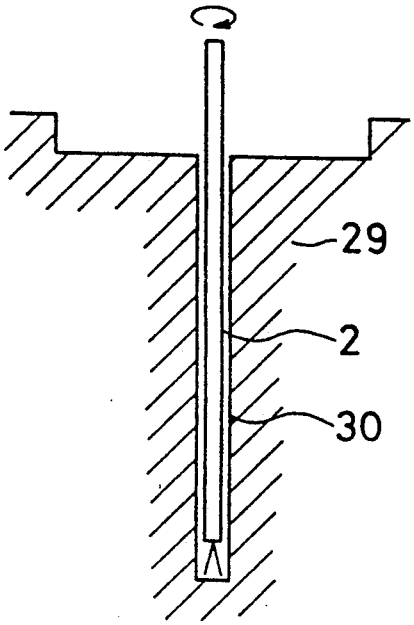
(a)
FIG. 4
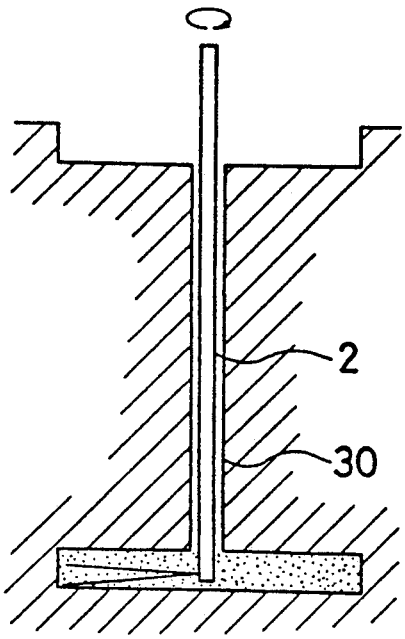
(b)
FIG. 4

(c)

(d)

(e)

(f)

SHAFT CONSTRUCTION METHOD

BACKGROUND OF THE INVENTION

1. Field of the Invention

The present invention relates to a method of constructing a shaft with improved operating efficiency.

2. Description of the Prior Art

When a scheduled building construction site has poor ground, the ground is generally given improvement treatment prior to the construction. Such ground treatment usually consists of hardening the soil by permeating it with a hardening agent. One method that has come into extensive use in recent years is the injection mixing method in which air and hardener are forced into the ground under high pressure to form a pile-shaped solid mass. The apparatus for implementing the injection mixing method consists of a high-pressure pump for pumping the cement or the like that constitutes the hardener; a compressor to supply the air; and a machine to operate a double-walled boring pipe the tip of which is provided with a nozzle.

The high-pressure pump is usually a plunger-type pump, which is used to pump the hardener from a mixer under very high pressure. The machine mixes the air and hardener and injects it into the ground from the nozzle of the double-walled boring pipe. For this, the boring pipe is inserted into a borehole in the ground, and for the injection process is revolved while being raised up from the bottom part of the hole. A columnar mixed region of soil and hardener is thereby formed in the ground and with the setting of the hardener forms into a pile-shaped solid mass.

The injection mixing method is widely employed because it provides good operational efficiency. However, the diameter of the columnar mixed region is dependent on soil condition and pump performance, and in sandy soil or clay the standard effective diameter is limited to 2000±200 mm.

FIG. 6 illustrates the method generally employed to construct a shaft having an inside diameter of 3500 mm, as shown in FIG. 5, using the injection mixing method. The double-walled boring pipe of the operating machine is inserted into the bottom 101 of the shaft 100 in sequence from al to a4 to inject the hardener and form a columnar mixed region 102. The double-walled boring pipe is then inserted from b1 to b10 around the perimeter of the shaft 100 to form a columnar mixed region 103. After the hardener has set, the inner portion of the mixed region 102 is excavated to produce the shaft 100 having the prescribed diameter.

With the conventional shaft construction method described above, the operation of removing the portion indicated in the drawing by shading to produce the requisite diameter D is rendered difficult owing to the fact that the hardener has set. This lowers operating efficiency. In addition, the need to form numerous columnar mixed regions 102 and 103 requires much time.

SUMMARY OF THE INVENTION

It is therefore an object of the invention to provide a shaft construction method that enables shafts of the requisite diameter, together with a continuous wall, to be constructed quickly.

The present invention realizes this object by providing a shaft construction method comprising a first step in which air and a ground hardener are injected by the depthwise operation of a revolving jetting element to form a columnar mixed region of soil and hardener in the ground; a second step in which an inhibitor that inhibits the hardening of the hardener is injected into the inner side of the columnar mixed region by the depthwise operation of the jetting element, wherein the injection pressure is set to produce a diameter that is smaller than that of the columnar mixed region; and the removal of the portion of the ground in which the hardening is inhibited by the inhibitor.

The shaft construction method further comprises a first step in which air and a ground hardener are injected by the depthwise operation of a revolving jetting element to form a columnar mixed region of soil and hardener in the ground; a second step in which an inhibitor that inhibits the hardening of the hardener is injected into the inner side of the columnar mixed region before the columnar mixed region has hardened to a specified strength; and removal of the portion of the ground in which the hardening is was inhibited by the inhibitor.

The shaft construction method further comprises the depthwise operation of a revolving operating pipe that is revolved within a prescribed range and operated to inject or jet ground hardener from jetting elements provided on the side of the operating pipe to form a columnar mixed region of soil and hardener in the ground, wherein these columnar mixed regions are provided side by side to form a continuous wall of shafts.

The shaft construction method further comprises the depthwise operation of a revolving operating pipe that is revolved within a prescribed range and operated to inject or jet ground hardener from jetting elements provided on the side of the operating pipe to form a columnar mixed region of soil and hardener in the ground, wherein the jetting element is operated at a prescribed spacing around the perimeter of a circle or an ellipse to form columnar mixed regions on the outer side of the circle or ellipse.

The shaft construction method also comprises the depthwise operation of a revolving operating pipe that is revolved within a prescribed range and operated to inject or jet ground hardener from jetting elements provided on the side of the operating pipe to form a columnar mixed region of soil and hardener in the ground, wherein the jetting element is operated beforehand at the bottom part of the shaft to form a pile of a set thickness at the bottom part of the shaft.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The objects and features of the present invention will become more apparent from a consideration of the following detailed description taken in conjunction with the accompanying drawings which are given by way of illustration only, and thus are not limitative of the present invention, and in which:

FIG. 3 and FIGS. 4*a* to 4*f* are cross-sectional views illustrating the steps of the shaft construction method of this invention;

DETAILED DESCRIPTION OF THE PREFERRED EMBODIMENT

The invention will now be described in detail with reference to the drawings.

Figure 1:
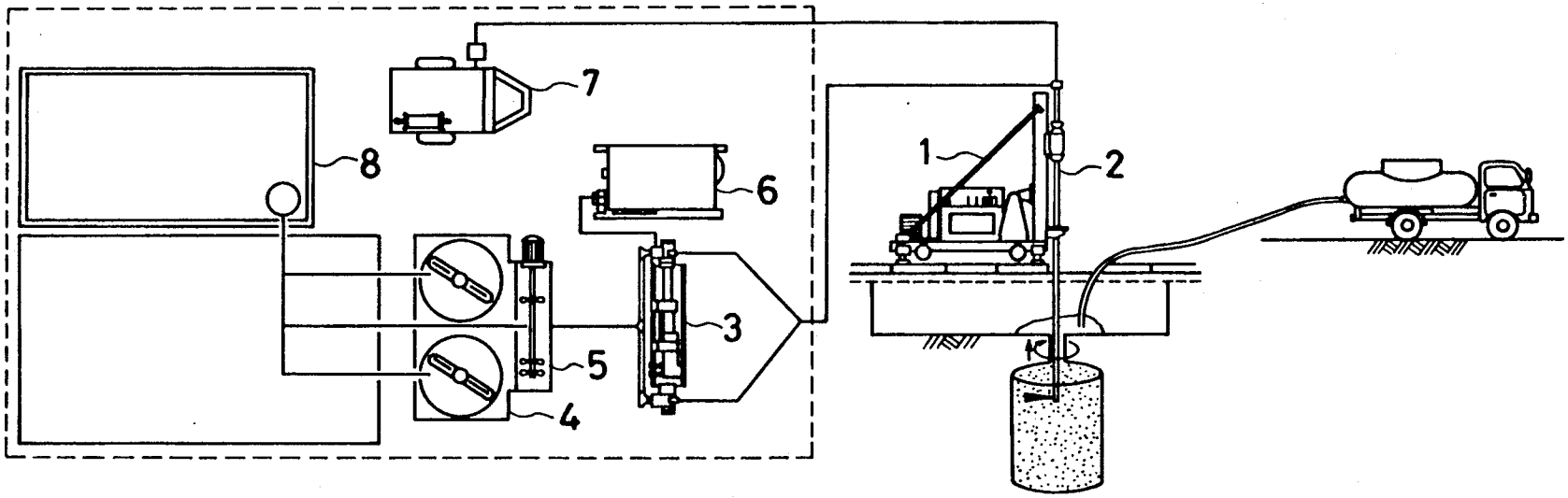
FIG. 1 is a drawing showing an overall view of the shaft construction method according to the present invention.

FIG. 1 shows an example of an apparatus used in the construction method of this invention. In FIG. 1, reference numeral 1 denotes a machine for raising, lowering and revolving a double-walled boring pipe 2; reference numeral 3 denotes a high-pressure pump for pumping hardener mixed by a mixer 4 and an agitator 5. Numeral 6 denotes a hydraulic unit that drives the high-pressure pump 3 and numeral 7 denotes a compressor for mixing air in with the hardener pumped by the high-pressure pump 3. A pump (not shown) is used to supply the mixer 4 with water from a water tank 8.

The end of the double-walled boring pipe 2 of the machine 1 is provided with a nozzle (not shown) from which hardener pumped by the pump 3 is injected into the ground.

The machine 1 is equipped with a drive section for general rotation of the double-walled boring pipe 2 and a drive section for rotating the double-walled boring pipe 2 within a prescribed range, and is provided with a switchover device for selecting the drive.

The drive sections rotate the double-walled boring pipe 2 by means of a rack and pinion arrangement, for example, with the pinion imparting a reciprocating action to the rack. As one example, a projecting portion is provided at each end of the rack to operate a microswitch and thereby change the direction of rotation of the boring pipe 2. The degree of rotation of the double-walled boring pipe 2 can be controlled by shifting the position of the projecting portions on the rack, thereby changing the position at which the microswitches are operated.

Figure 2:
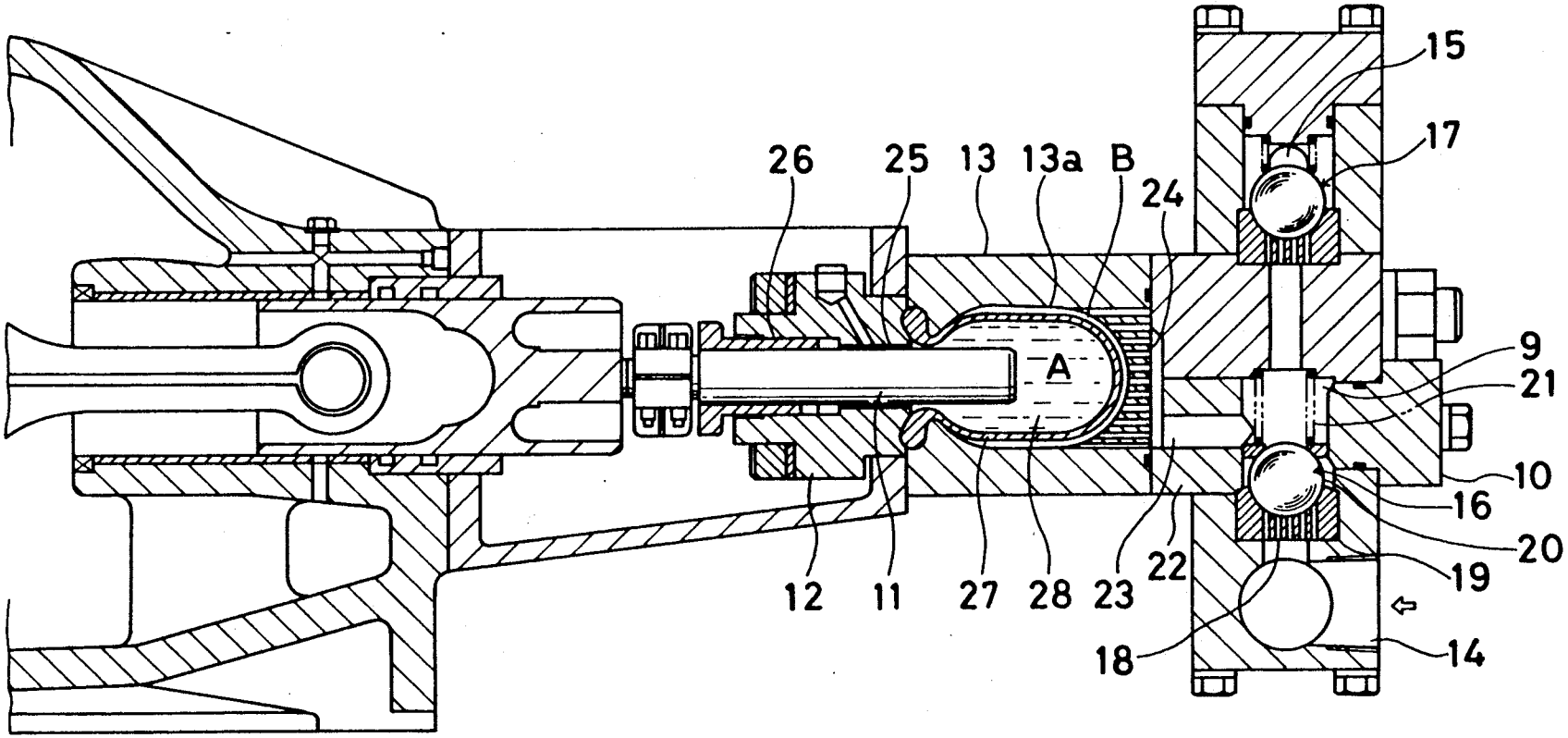
FIG. 2 is a cross-sectional view of the high-pressure pump employed, in the present invention.

An example of the high-pressure pump 3 will now be described with reference to FIG. 2. The high-pressure pump 3 is comprised of a valve box 10 provided with a valve chamber 9, a plunger box 12 provided with a plunger 11, and a box 13 forming a pressure action chamber 13*a* disposed between the valve box 10 and the plunger box 12.

The valve box 10 has an inlet passage 14 and an outlet passage 15 that communicate with the valve chamber 9 and which are provided with an inlet valve 16 and an outlet valve 17, respectively. The inlet valve 16 and the outlet valve 17 each have a valve seat 19 formed into a concave, semi-spherical shape and a multiplicity of small holes 18 that extend axially from each seat; a valve-piece 20 that has a spherical shape corresponding to the concave shape of each valve seat; and a valve spring 21 that urges each valve-piece against the seat 19. The holes 18 are for limiting the in-flow of particles that exceed a given size.

In the side wall 22 of the valve box 10 is a passage 23 that connects the pressure-action chamber 13*a* with the interior of the valve chamber 9, and provided at the opening of the passage at the pressure-action chamber 13*a* end is a screening member 24 constituted by a mesh screen or the like that limits the entry of particles that exceed a given size.

The end of the plunger 11, which is maintained within a cylinder 25 in the plunger box 12 via a V-packing 26 so as to project into the pressure action chamber 13*a*, is reciprocated at high speed by a drive means (not illustrated).

A resilient membrane 27 is provided in the pressure-action chamber 13*a* to divide the pressure-action chamber 13*a* into a cylinder 25, side A, and a valve chamber 9, side B The cylinder 25, side A, of the resilient membrane 27 is filled with an operating medium 28, such as oil.

Figure 4:
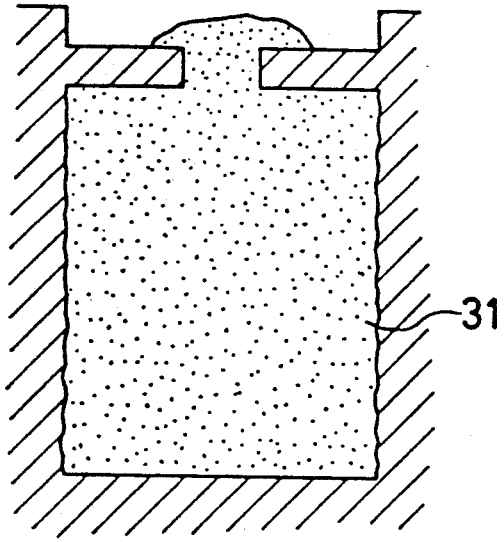
Figure 4:
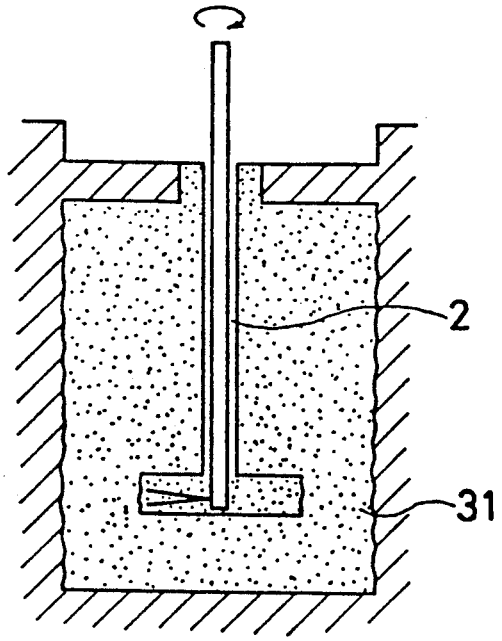
Figure 4:
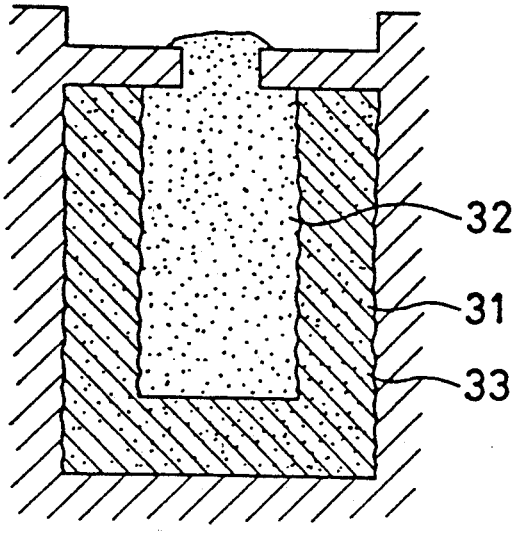
Figure 4:
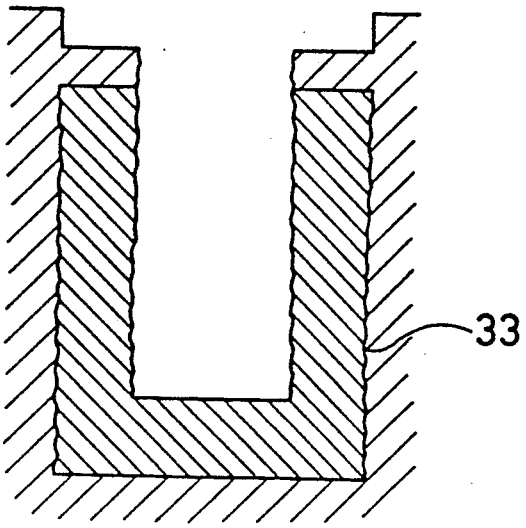
Figure 5:
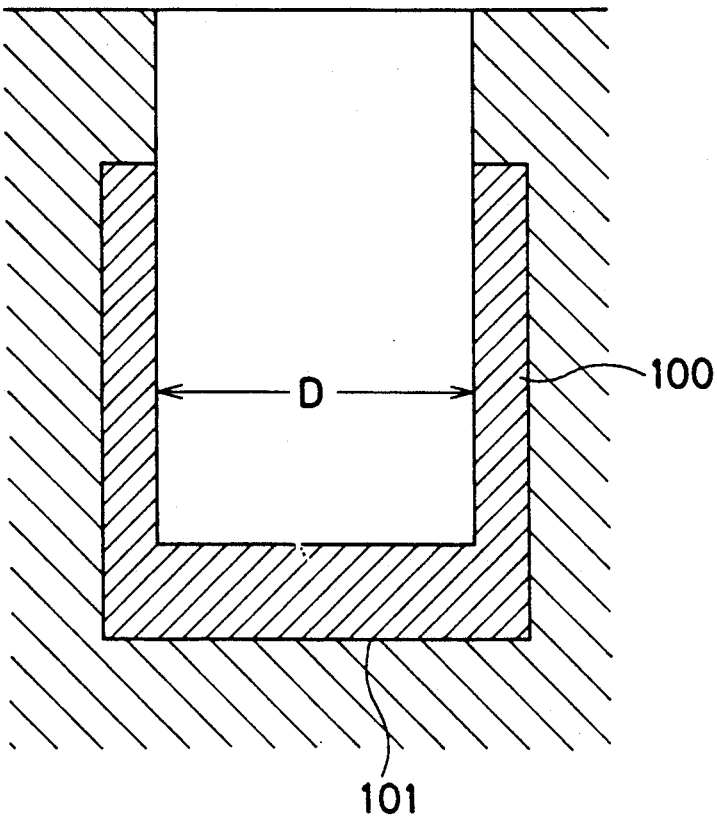
FIG. 5 is a cross-sectional view of a shaft.
Figure 6:
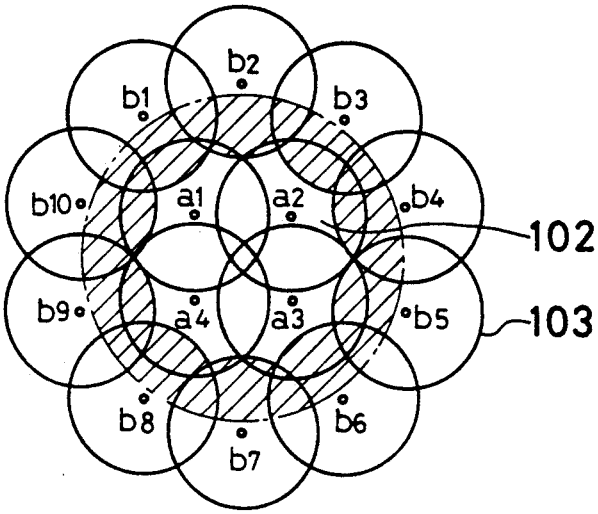
FIG. 6 PRIOR ART
FIG. 6 is a general view illustrating a conventional shaft construction method.

Construction of a shaft, such as the one shown in FIG. 3, using the above apparatus will now be described. The double-walled boring pipe 2 of the machine 1 is positioned at the location where the shaft is to be constructed. The boring pipe is then used to bore a hole to the required depth, using an appropriate pipe rotation and boring rate for the conditions of the ground concerned (FIG. 4*a*). The double-walled boring pipe 2 uses high-pressure jetting from its nozzle to bore the hole, penetrating into the ground 29 under its own weight. Alternatively, the boring pipe 2 may by inserted after the hole has been bored by another means.

After the hole has been bored to the required depth, the revolving boring pipe 2 is then withdrawn up the borehole 30 (FIG. 4*b*) while the high-pressure pump 3 is operated to inject hardener from the nozzle. The rate at which the boring pipe 2 is withdrawn up the borehole and the rate at which the pipe is rotated are set in accordance with the nature and softness of the ground concerned. The hardener consists of cement such as portland cement, for example, as the main constituent and an admixture of a water-reducing agent such as montmorillonite or calcium, suitably combined with a cement-based ground improvement, with the proportions of the constituent components being changed to suit the ground concerned, and mixed with water.

The injection of the hardener breaks up the texture of the soil ground and forms a columnar pile 31 in the ground, such as shown in FIG. 4*c*. The double-walled boring pipe 2 is then inserted in the center of the pile 31. This insertion of the boring pipe 2 is preferably done after the pile 31 has hardened to some extent. For example, the insertion is started after the initial hardening of the cement. The boring pipe 2 is inserted to a depth that is slightly above the depth to which it was inserted to inject the hardener. The high-pressure pump 3 is then operated to pump in an inhibitor that inhibits the setting of the hardener. The main constituent of the hardener being cement, which is alkaline, an acid inhibitor is employed. The pump delivery rate for pumping the inhibitor is set below the rate used to inject the hardener.

As it revolves, the double-walled boring pipe 2 is gradually raised up from the bottom part of the pile 31 while the injection of the inhibitor from the nozzle proceeds (FIG. 4*d*), whereby the inhibitor forms a pile 32 within the pile 31 (FIG. 4*e*). Thus, the hardener is inhibited from setting at the inner part of the pile 31 and only sets at the outer part 33. This inner part which does not harden owing to the action of the inhibitor can then be easily excavated to thereby form the required shaft (FIG. 4*f*).

Figure 7:
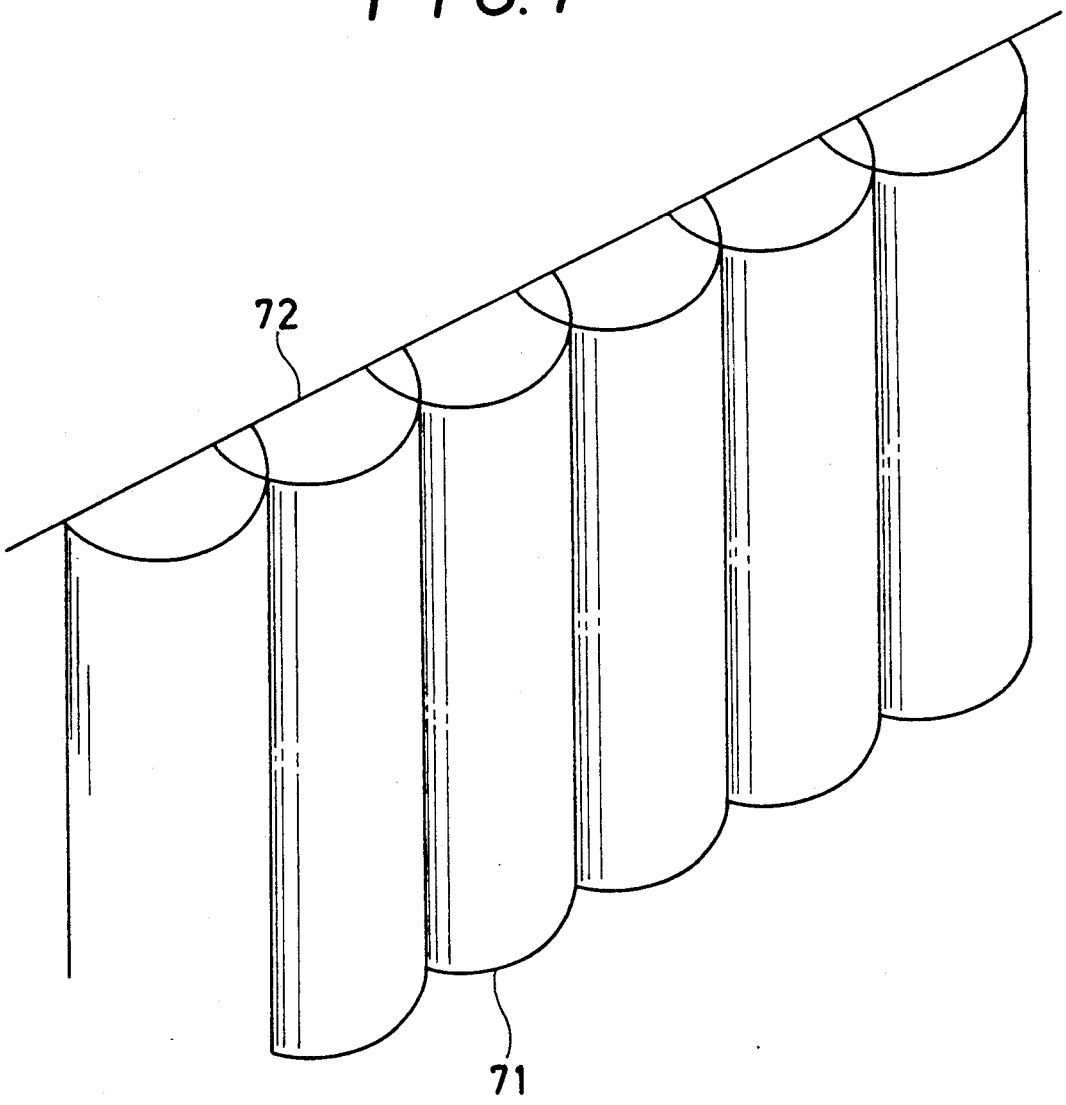
FIG. 7 is a perspective view showing a wall constructed using the shaft construction method of the invention.

The use of the above apparatus to construct the continuous wall illustrated in FIG. 7 will now be described. In the same way as when constructing the shaft described above, the double-walled boring pipe 2 of the machine 1 is positioned at the location where the continuous wall is to be constructed and the boring pipe is used to bore a hole to the required depth, using an appropriate pipe rotation and boring rate for the conditions of the ground concerned (FIG. 4*a*). The double-walled boring pipe 2 uses high-pressure jetting from its nozzle to bore the hole, penetrating into the ground 29 under its own weight. Alternatively, the boring pipe 2 may by inserted after the hole has been bored by another means.

After the hole has been bored to the required depth, the revolving boring pipe 2 is then withdrawn up the borehole 30 (FIG. 4*b*) while the high-pressure pump 3 is operated to inject hardener from the nozzle. The rate at which the boring pipe 2 is withdrawn up the borehole and the rate at which the pipe is rotated are set in accordance with the nature and softness of the ground concerned. The composition of the hardener is the same as that of the hardener used for the above shaft construction.

The injection of the hardener breaks up the texture of the soil ground and forms a columnar pile 31 with a fan-shaped cross-section, as shown in FIG. 4*c*. These piles 31 having a semicircular cross-section are formed with an overlap between adjacent piles. This results in the formation of a continuous wall 72 of columnar piles 71, as shown in FIG. 7.

Figure 8:
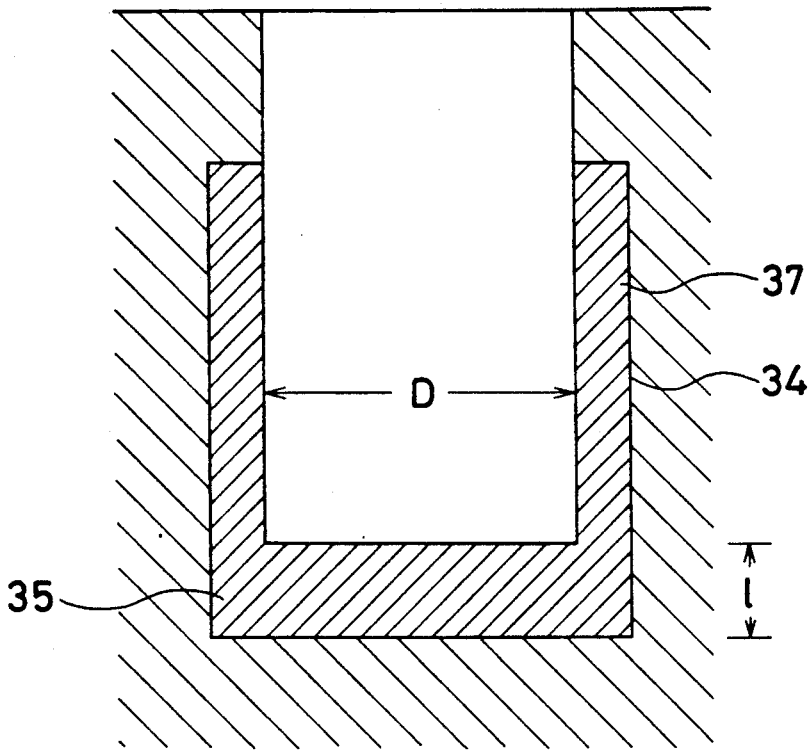
FIGS. 8 to 11 are drawings illustrating the construction of round or ellipsoid shafts by the method of the present invention.
Figure 9:
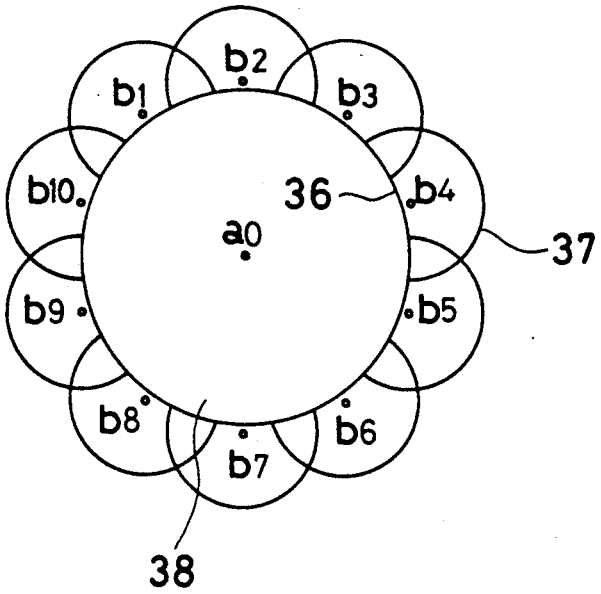

FIG. 8 shows a shaft 34 having a prescribed inside diameter D, constructed by the following method. The double-walled boring pipe 2 is inserted into the ground to a fixed depth and rotated to inject hardener to form a columnar pile 35 having a diameter that is at least D. The pile 35 thus formed has a set thickness l at the position that forms the bottom of the shaft 34. Next, with reference to FIG. 9, the double-walled boring pipe 2 is operated at evenly spaced positions b1 to b10 around the perimeter of a circle 36 of a diameter D to form fan-shaped columnar piles 37 on the outside of the circle 36 with a partial overlap between adjacent piles 37. Earth and sand, etc., are then removed from an inner portion 38 enclosed by the piles 37 to thereby form the shaft 34.

Figure 10:
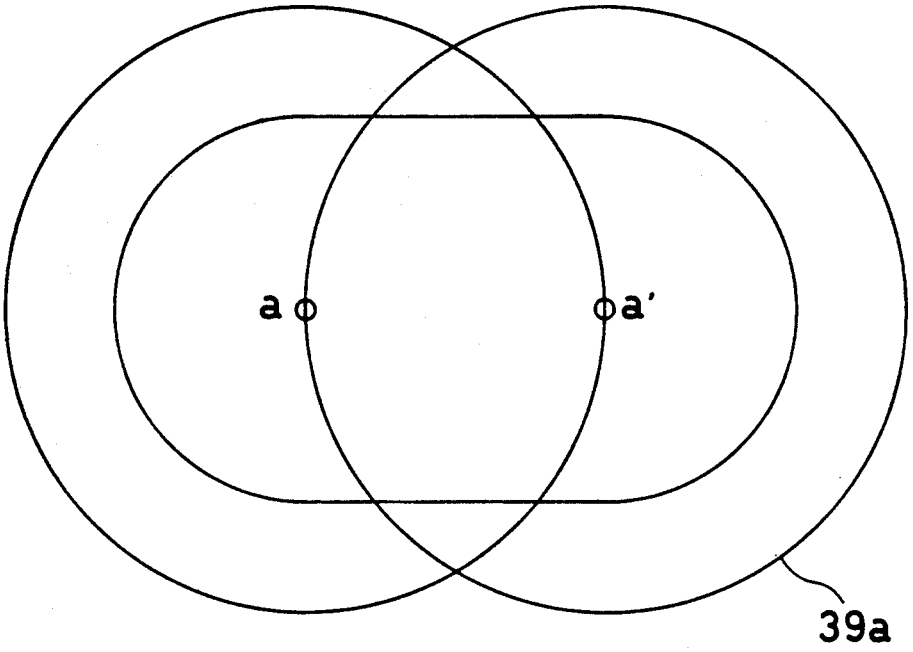
Figure 11:
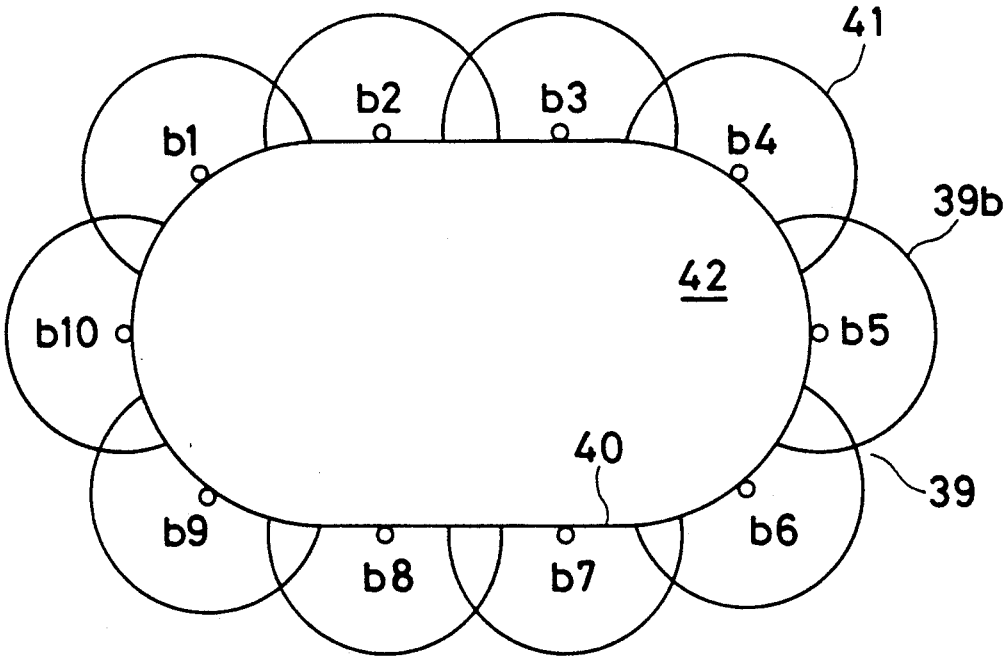

FIGS. 10 and 11 illustrate a method of constructing an ellipsoid shaft 39. In this case, when constructing the bottom 39*a* of the shaft 39, the double-walled boring pipe 2 is operated twice at points a and a' which are offset relative to each other by a set distance. The double-walled boring pipe 2 is then operated at evenly spaced positions b1 to b10 around the perimeter of an ellipsoid 40 to form fan-shaped columnar piles 41 around the ellipsoid 40 with a partial overlap between adjacent piles 41, to thereby form a side wall 39*b* of the shaft 39. The ellipsoid shaft 39 is then formed by removing the soil from an inner portion 42 enclosed by the piles 41.

As has been described in the foregoing, the shaft construction method according to the present invention offers numerous features, advantages and effects which will now be summarized.

For example, in making a large diameter shaft, a hardening inhibitor is injected into the interior of a large-diameter columnar mixed region formed by injection mixing using a high-pressure pump, which thereby enables such a large-diameter shaft to be produced simply by removing the soil from the inner portion, thus considerably shortening the required construction time, compared with the conventional method of shaft construction by injection mixing. It is also economical, because by just changing the pump delivery rate the same nozzle can be used for the injecting of the inhibitor as well as the hardener. Also, as the setting of the hardener is inhibited in the portion injected with the inhibitor, it is easy to excavate.

In accordance with another aspect of the invention, an inhibitor is injected into the inner portion of a large-diameter columnar mixed region formed by the injection mixing method. This inhibits the setting of the hardener in that portion, thus making the formation of the required shaft a simple matter of excavating the inner portion.

In another aspect of the invention, using a pump-driven injection mixing method in which the pipe element is rotated stepwise by prescribed degrees to construct piles side by side with some overlap it easy to form a continuous wall where it is desired to avoid the injection of hardener This is ideal when it is necessary to prevent hardener flowing into a nearby river, for example.

Claim 4 describes the construction of a circular or elliptical shaft in which the excavation of the central portion is facilitated is accomplished, thus, improving construction efficiency.

Another advantage of this invention resides in the fact that because the high-pressure pump used has 2.5 or 3 times more output capacity than the pumps used in the prior art, the injection mixing method can be used to construct a columnar pile at the bottom of the shaft in a single step. Moreover, as the size of the radius of the semicircular piles is proportional to the pump output, compared with the prior art, it takes fewer injection operations to construct a shaft, and is therefore more efficient.

I claim:

1. A method for constructing a shaft comprising:

injecting air and a ground hardener in a depthwise direction through a revolving jetting element and forming a columnar mixed region of soil and hardener in the ground;

injecting an inhibitor which inhibits the hardening of the hardener into the columnar mixed region in a depthwise direction through the jetting element at a pressure producing a diameter that is smaller than the diameter of the columnar mixed region, and removing the portion of the ground the hardening of which was inhibited by the inhibitor.

2. A method for constructing a shaft comprising:

injecting air and a ground hardener in a depthwise direction through a revolving jetting element and forming a columnar mixed region of soil and hardener in the ground;

injecting an inhibitor which inhibits the hardening of the hardener into the interior portion of the columnar mixed region before said columnar mixed region has hardened to a specified strength, and removing the portion of the ground the hardening of which was inhibited by the inhibitor.

3. A method according to claim 2, comprising revolving an operating pipe provided with jetting elements on the side thereof within a prescribed range in a depthwise direction and forming a shaft, injecting ground hardener through said jetting elements and forming a columnar mixed region of soil and hardener in the ground, said jetting elements being activated initially at the bottom part of said shaft and forming a pile of a set thickness at the bottom part of the shaft.

4. A method for constructing a shaft comprising:

pivoting an operating pipe at each of a plurality of overlapping spaced areas disposed in a side by side relationship with respect to each other, said pipe being pivoted less than 360° at each of the plurality of areas, the pipe being provided with jetting elements on the side thereof, within a prescribed range, injecting ground hardener through said jetting elements and forming a plurality of columnar mixed regions of soil and hardener in the ground, said columnar mixed regions being disposed in an overlapping side by side relationship with respect to each other and forming a generally flat, continuous wall of shafts along one side thereof.

5. A method for constructing a shaft comprising:

pivoting an operating pipe provided with jetting elements on the side thereof in a depthwise direction within a prescribed range at a plurality of spaced areas around the perimeter of a circle or an ellipse, the pipe being pivoted less than 360° at each of the plurality of spaced areas, injecting ground hardener through said jetting elements and forming columnar mixed regions of soil and hardener in the ground, said columnar mixed regions being disposed in an overlapping side by side relationship with respect to each other on the outer side of said circle or ellipse to thereby form a generally smooth, continuous wall around the circle or ellipse.

* * * * *